United States Patent [19]

Brammer et al.

[11] 4,088,853

[45] May 9, 1978

[54] IGNITION DISTRIBUTOR-BREAKER STRUCTURE FOR INTERNAL COMBUSTION ENGINES

[75] Inventors: Hartmut Brammer, Vaihingen, Enz; Karl Ehrmann, Stuttgart; Jörg Issler, Stuttgart-Sud; Friedrich Jaki, Ermannshausen; Harald Kalippke, Hohenacker; Herbert Mägdefrau, Sonthofen; Rolf Rink, Markgroningen, all of Germany

[73] Assignee: Robert Bosch GmbH, Stuttgart, Germany

[21] Appl. No.: 738,490

[22] Filed: Nov. 3, 1976

[30] Foreign Application Priority Data

Dec. 9, 1975 Germany ..... 2555271

[51] Int. Cl.[2] ..... H01H 19/00; F02P 7/02

[52] U.S. Cl. ..... 200/19 R; 123/146.5 A

[58] Field of Search ..... 200/19 R, 19 A, 20, 200/21, 31 R, 31 A, 31 CA, 31 DP, 31 V, 293, DIG. 44; 308/72, 134.1, DIG. 4, DIG. 5; 123/146.5 R, 146.5 A, 148 R

[56] References Cited

U.S. PATENT DOCUMENTS

| | | | |
|---|---|---|---|
| 2,016,669 | 10/1935 | Davis, Jr. | 123/146.5 A X |
| 2,124,479 | 7/1938 | Whitaker | 308/134.1 X |
| 2,176,164 | 10/1939 | Arthur | 200/19 A |
| 2,187,070 | 1/1940 | Arthur | 200/31 CA |
| 2,233,104 | 2/1941 | Martinet | 308/DIG. 5 |
| 2,308,609 | 1/1943 | Koch | 308/DIG. 5 |
| 2,352,958 | 7/1944 | Lauer et al. | 308/DIG. 5 |
| 2,713,096 | 7/1955 | Brunk | 200/31 DP |
| 2,889,418 | 6/1959 | Kline | 200/19 R |
| 3,416,847 | 12/1968 | Daley et al. | 308/72 X |
| 3,794,795 | 2/1974 | Tromans | 200/19 R X |
| 4,033,315 | 7/1977 | Kroger et al. | 123/146.5 A |

FOREIGN PATENT DOCUMENTS

| | | | |
|---|---|---|---|
| 1,194,738 | 11/1959 | France | 123/146.5 A |

*Primary Examiner*—James R. Scott
*Attorney, Agent, or Firm*—Flynn & Frishauf

[57] ABSTRACT

To reduce the axial length of distributor-breaker assemblies and to provide for reliable placing of a second upright bearing for the distributor shaft, a holding plate to which a bearing is floatingly attached is clamped in the distributor housing by means of a claw clamp, tightened by a transverse plate against itself and against a shoulder formed in the inner side wall of the distributor, the claw clamp being formed as a partly circumferential ring seated in a groove of the distributor.

13 Claims, 3 Drawing Figures

IGNITION DISTRIBUTOR-BREAKER STRUCTURE FOR INTERNAL COMBUSTION ENGINES

FIELD OF THE INVENTION

The present invention relates to the structural arrangement of a distributor-breaker contact unit for internal combustion engines, in which a central shaft is located within a cup-shaped housing, the shaft being journalled in two bearings located axially along the structure, one of the bearings forming a structural assembly with its holding device, typically a holding plate.

BACKGROUND AND PRIOR ART

Distributor structures of the type to which the present invention relates can be constructed to have a comparatively short axial length; this permits their use in installations where space is severely limited; these structures require, however, two bearings for the distributor shaft in order to reliably guide the shaft therein.

It has previously been proposed to construct distributor-breaker assemblies in such a manner that a bearing support for the second bearing is located within a hollow cylindrical section placed on the open facing side of the housing, the bearing support being secured to the housing by means of projecting eyes and with attachment screws. This requires a substantial diameter for the structure in order to provide sufficient strength for the eyes, although the axial length can be reduced with respect to previously employed distributor structures, and additionally requires time-consuming assembly and strengthening material.

SUMMARY OF THE INVENTION

It is an object to improve distributor-breaker assembly structures to permit reducing their size while so arranging the various components that the entire structure can be easily assembled.

Briefly, a bearing support element is provided, preferably a plate extending transversely of the cup-shaped housing, which is clamped to the inner wall of the housing by means of a claw clamp. Thus, the bearing support plate is centered in the housing axially as well as radially, and secured thereto by tightened claw clamps located at least approximately diametrically from each other within the housing. The claw clamp is preferably formed by means of a snap ring fitting into a groove in the housing of the distributor-breaker unit, tightened against the bearing support plate by screws, the plate itself being seated against the shoulder within the housing. The plate and the bearing can thus form a single unitary assembly.

Claw-type clamps of course are well known as structural devices to secure any element into or against another one; in ignition distributors, however, this type of clamping or holding arrangement has not been used; in accordance with the present invention, the plate, the claw clamp and its holding attachment are so arranged relative to each other that they, additionally, permit the axial extent of the claw clamping arrangement to be used for a floating bearing which forms the second bearing of the distributor shaft.

In accordance with a feature of the invention, the housing forms a pair of shoulders or abutments, one of which is open to the open end face of the distributor-breaker housing so that the side wall of the breaker housing beyond the shoulder will have a reduced thickness to permit removal of the support plate and the attached bearing by merely lifting it out of the housing. The other shoulder is formed by a groove or notch within the side wall of the housing. To make the housing, therefore, a simple lathe or screw machine operation is all that is needed, or the housing itself can be cast or molded, as an element with the groove and the clearance area already provided. To ensure reliable holding of the claw and attachment of the bearing, the claw is formed as a snap ring extending over more than 180° of the circumference, snapped in the groove and formed with internally projecting eyes. The portion surrounding the eyes can then be tightened against a projecting rivet on the bearing plate, the rivet being used to hold the bearing support in place. The snap ring with its eyes can be radially compressed to snap into the groove formed in the housing. Its outwardly directed resilient force is sufficient to hold it in place; to prevent relative rotation, the outer circumference of the snap ring is preferably formed with projecting teeth, burrs, and the like, which can dig into the material of the housing as the ring is snapped into its groove.

In accordance with a further feature of the invention, the second bearing, preferably, is a floating bearing, with at least part-spherical outer portions which are held in a tapering or rounding clamping eye. This provides for self-adjustment and self-alignment of the bearing housing and substantially facilitates manufacture and assembly, since careful tolerances of axial alignment of the bearing support plate and its bearing with the main bottom bearing of the distributor are no longer needed. Further, the bearing holder can be stamped, thus can be made accurately and inexpensively. The bearing plate and the snap ring are fixed circumferentially by a projection formed on the snap ring which engages a matching slot of the bearing plate, so that the circumferential placement of the bearing plate with respect to the clamp ring is fixed without requiring visual adjustment of the circumferential position of the bearing plate. Once the projection is snapped into its matching slot, the bearing plate can be clamped to the snap ring and the entire assembly will be reliably held - an assembly operation which can be carried out quickly and inexpensively.

Figure 1:
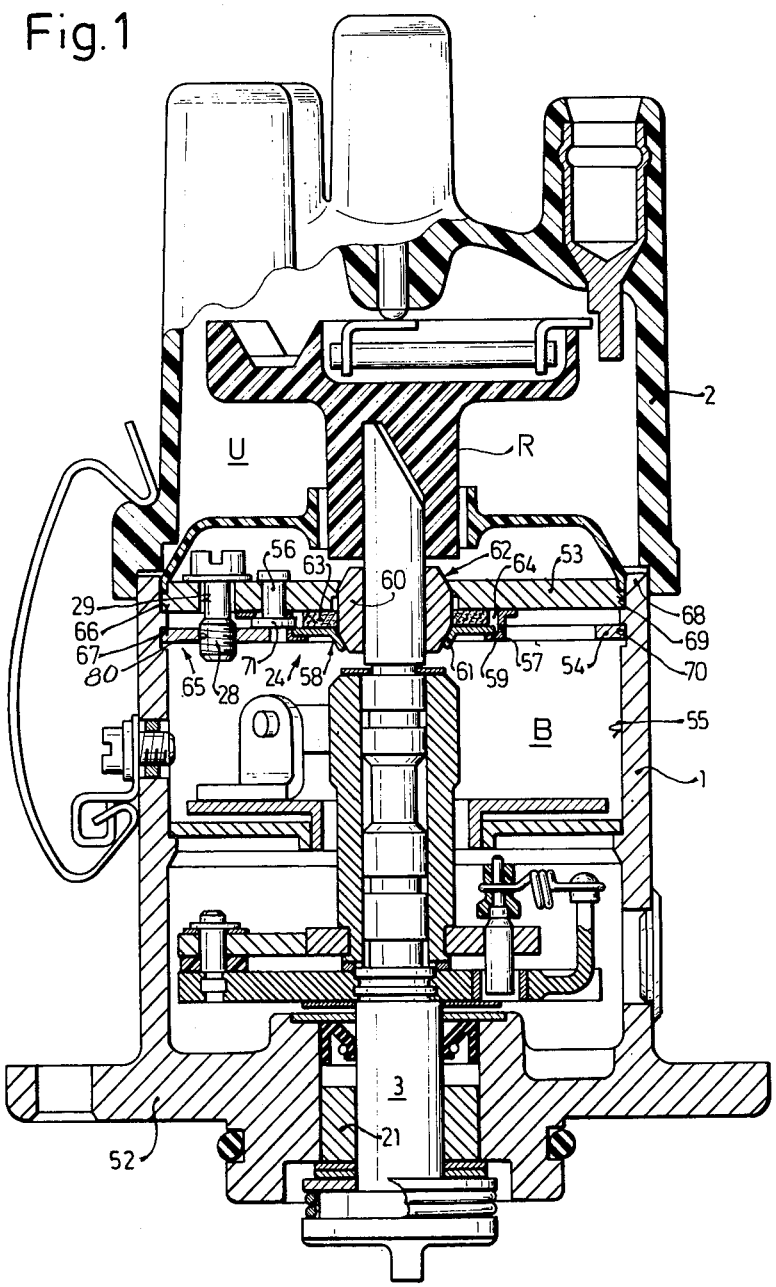
FIG. 1 is a longitudinal axial section through the distributor-breaker structure, in which the electrical distributor elements and breaker elements are shown schematically only.
Figure 2:
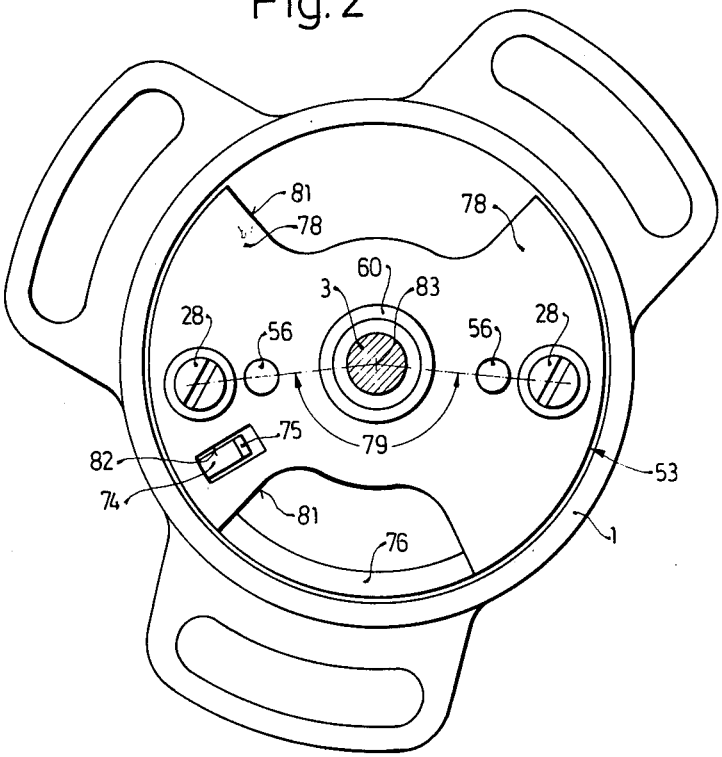
FIG. 2 is a top view of the structure with the distributor cap and the distributor rotor, and the dust cap therefore removed.

The distributor structure (FIGS. 1 and 2) has a cup-shaped housing 1 which forms a bottom portion 52 in which a first or main bearing 21 is provided through which shaft 3 extends. The shaft 3 is secured at its upper end by a second bearing 62.

In accordance with the present invention, the second bearing 62 forms a unit with a support element 24 therefor, which is secured in the inner wall 55 of housing 1 by means of a claw clamp, tightened against the housing by screws 28. The claw is formed by support plate 53 and a snap ring 54 which, at its radially inwardly directed end, bears against rivets 56 secured to plate 53. Rivets 56 are used to hold a holding element 57 which, in turn, secures a clamping eye strap 58 which engages an outer bearing ball 60. The bearing ball 60 has at least a part-cylindrical outer surface and at its upper end — with respect to FIG. 1 — is engaged by support plate 53; the lower side is engaged by a spherical stamped projection 61 extending from the eye strap 58 downwardly, to form a spherical self-aligning, floating bearing. The bearing ball, which can be part-cylindrical and barrel-shaped, is in contact with a lubricating sponge or felt 63 placed into the space between plate 53 and the eye strap 58. An axial oil bore or a porous section within the barrel or ball 60 provides lubricant to the interface between the shaft 3 and the ball or barrel 62. The gap or space within which the sponge or felt 63 is located is shown at 64.

The inner wall of the housing 1 is formed with two pairs of shoulders 65 placed in planes approximately transversely to the shaft 3. The upper shoulder 66 is formed as an internal recess from the normal side wall thickness of the housing to form an open section 69 having a greater clear diameter than the inner diameter of the housing below the bearing structure. The other shoulder 67 is formed as a groove or notch 70 in the inner wall 55. The sum of the thickness of the rivet head 71 and of the holding element 57 for the eye strap 58 corresponds approximately to the distance between the two shoulders or abutments 66, 67 of each of the pairs of shoulders 65. These shoulders are located approximately diametrically from each other with respect to the distributor and extend at least in part circumferentially around the distributor. They may be formed as continuous shoulders extending all around the distributor housing.

Figure 3:
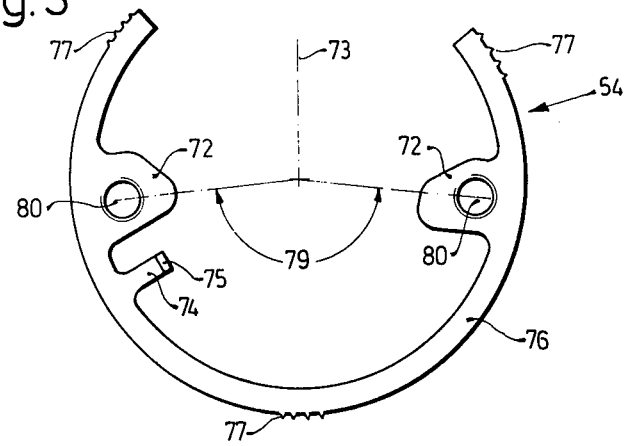
FIG. 3 is a top view of the claw snap ring.

The clamp element 54 — see FIG. 3 — is a snap ring which is open with respect to a plane of symmetry 73. Each one of the symmetrical halves is formed with an internally projecting eye 72 which has a threaded bore 80 therein. The threaded bore 80 is threaded to receive a respective screw 28. A locating projection 74 with an axially bent-over hook 75 extends radially inwardly from the snap ring 54, located at only one side of the plane of symmetry 73. A plurality of outwardly projecting teeth, burrs, or the like, project from the outer circumference 76 of the snap ring 54. Preferably, three groups of teeth 77 are provided; these teeth will dig into the groove formed in the inner wall of the housing 1 when the snap ring 54 is assembled therein, to provide for reliable holding within the groove. The angle 79 between the center of the bores 80 is less than 180°.

The bearing plate 53 is wing-shaped, having two projecting wings 78 interrupted by recesses 81. One of the halves 78 is formed with a notch 82 shaped to be engaged by the hook 75 of the internal projection 74 of snap ring 54; the side of the notch 82, which is slot-shaped, and the distance from the center 83 of the shaft 3 is the same for the projection 74 and the angle 75 as well as for the slot 82, the slot 82 being slightly larger to provide clearance. The angle included between the rivets 56 and the holding screws 28 is, like angle 79, somewhat less than 180° so that, when the projection 74 and the angled-off end 75 engages in the notch 72, the bores 29 of the bearing plate 53 match the corresponding tapped bores 80 of the clamping ring 54.

Assembly and operation: First, spring or snap ring 54 is snapped into the groove 70; the groove 70 either terminates at fixed positions circumferentially of the structure, or has locating indicia to permit alignment of the ends, or similar locating indicia on the snap ring 54. Upon snapping ring 54 into the groove 70, the teeth 77 will dig into the housing and hold it securely and against rotational movement. The poles 80 may be used to slightly radially compress the spring to facilitate insertion. After placement of ring 54, holding plate 53, with the bearing 62 assembled thereto as a unit, is inserted in the open section 69 of the housing and rotated until the projection 74 with the angled-over end 75 snaps into the notch 82. The holes 29 in the plate and the holes 80 in the snap ring will thereupon be aligned and screws 28 can be threaded into the corresponding holes 80 until the snap ring 54 and the bearing plate 53 engage both on the shoulder 66, 67 of the housing and the internally projecting portions 72 engage against the bottom heads 71 of the rivets 56. The bearing plate 53 is thus reliably clamped by a claw clamp. The engagement of the snap ring 54 with the respective rivet heads 71 additionally provides for stiffening of the plate 53 and stiffens the entire assembly 24 for the upper bearing 62.

The breaker assembly of the distributor-breaker unit is not shown in detail and located in chamber B; it may be of standard construction. The distributor rotor, schematically shown at R, is located in the upper chamber U formed within the distributor cap 2.

Various changes and modifications may be made within the scope of the inventive concept.

We claim:

1. Ignition distributor structure for multi-cylinder internal combustion engines having a cup-shaped housing (1);

a central shaft (3) passing through the housing;

a first bearing (21) located in the bottom (52) of the housing;

a second bearing (62) axially spaced from the first bearing;

a support plate (53) extending essentially transversely of the shaft (3) and across the housing; and supporting the second bearing (62);

shoulder means (66,) formed in the inner walls (55) of the housing to provide an abutment for said support plate (53);

and means securing said support plate (53) in the housing comprising a groove (70) formed in the inner wall (55) of the housing (1) and located axially spaced below said shoulder means (66), and forming a groove shoulder with respect to the inner wall (55) of the housing;

a snap ring (54) having a circumferential gap snapped into the groove (70) in the inner wall (55) of the housing;

and clamping screw means (28) engaging both the bearing support plate (53) and the snap ring (54) to clamp the bearing support plate to the shoulder means, and hence to the housing by clamping engagement of the bearing support plate and the snap ring with the shoulder means formed in the inner wall (55) of the housing, and, respectively, with the shoulder formed by said groove (70) into which the snap ring is snapped.

2. Structure according to claim 1, wherein the shoulder means (66) is formed by a recess open to the end of the cup-shaped housing (1) to provide a portion (69) of the cup shaped housing having a clearance diameter greater than that of the remainder of the housing (1).

3. Structure according to claim 3, wherein the support plate (53) has a transverse dimension just fitting within the open portion (69) of the housing (1) and seating against said shoulder means (66).

4. Structure according to claim 3, wherein the second bearing (62) is a floating bearing and includes a barrel or ball-shaped outer bearing element (60) and a part-spherical eye strap (58) holding the outer bearing element against the support plate (53).

5. Structure according to claim 4, further comprising a holding ring (57) formed with an axial offset (59) and securing the eye strap (58) in position against the support plate (53) and thereby supporting the spherical or barrel-shaped bearing element (60);

and headed attachment means (56) attaching the holding ring (57) to the support plate (53).

6. Structure according to claim 5, wherein the sum of the thickness of the head (71) of the headed attachment means (56) and the thickness of the holding ring (57) corresponds approximately to the distance between the shoulder means (66) and the shoulder (67).

7. Structure according to claim 5, wherein the space between the offset of the holding ring (57) and the eye strap (58) forms a lubricating reservoir;

and a porous lubricant-absorbent element (63) soaked with lubricant located in said space (64).

8. Structure according to claim 5, wherein the headed attachment means comprises rivets (56) having heads (71), a respective rivet and clamping screw means (28) being located approximately in radial alignment; two rivets (56) and two clamping screws means (28) being provided, located approximately diametrically with respect to the shaft (3) on the holding plate (53), the angle (79) included between opposite the clamping screw means (28) and rivets (56) being less than 180°.

9. Structure according to claim 1, wherein the second bearing (62) is a floating bearing and includes a barrel or ball-shaped outer bearing element (60) and a part-spherical eye strap (58) holding the outer bearing element against the support plate (53).

10. Structure according to claim 1, wherein the snap ring (54) has a radially inwardly and axially upwardly extending projection (74); and the support plate (53) is formed with a corresponding notch or slot (82) to be engaged by said projection and to position the support plate (53).

11. Structure according to claim 1, wherein the support plate (53) is formed with essentially diametrically placed cut-outs (81).

12. Structure according to claim 1, further comprising projecting means (56) extending from the support plate (53) in the direction of the snap ring (54) and located in approximate radial — with respect to the shaft (3) — alignment with the clamping screw means (28), and radially inwardly therefrom, the extent of projection of said projecting means corresponding approximately to the distance between the shoulder means (66) and the groove shoulder (67);

and said snap ring (54) is formed with internal projections (72) in axial alignment with said projecting means (56) whereby, upon tightening of said clamping screw means (28), the plate (53) will be held by a claw grip against said shoulder means and will be radially inwardly supported by said projecting means bearing against said inward projections of the snap ring.

13. Structure according to claim 13, wherein the projecting means comprises a rivet (56) having a rivet head (71), said rivet head bearing against said internal projections on the snap ring (54).

* * * * *